US005871224A

United States Patent [19]

Vance

[11] Patent Number: 5,871,224

[45] **Date of Patent: *Feb. 16, 1999**

[54] DOUBLE-EDGED SNOWBOARD

[76] Inventor: Mark D. Vance, 4208 242nd Ave. SE., Issaquah, Wash. 98027

[ * ] Notice: The term of this patent shall not extend beyond the expiration date of Pat. No. 5,580,078.

[21] Appl. No.: 939,059

[22] Filed: Sep. 29, 1997

Related U.S. Application Data

[63] Continuation of Ser. No. 758,969, Dec. 2, 1996, abandoned, which is a continuation of Ser. No. 151,344, Nov. 12, 1993, Pat. No. 5,580,078.

[51] Int. Cl.[6] ..... A63C 5/04

[52] U.S. Cl. ..... 280/608; 280/609; 280/14.2

[58] Field of Search ..... 280/14.2, 608, 280/609, 610

[56] References Cited

U.S. PATENT DOCUMENTS

| | | | |
|---|---|---|---|
| 3,304,095 | 2/1967 | Carlton | 280/609 |
| 3,395,411 | 8/1968 | Pope Jr. et al. | 280/609 |
| 4,919,447 | 4/1990 | Jackson et al. | 280/609 |
| 4,974,868 | 12/1990 | Morris . | |
| 5,018,760 | 5/1991 | Remondet | 280/609 |
| 5,135,249 | 8/1992 | Morris | 280/609 |
| 5,303,949 | 4/1994 | Harper et al. | 280/608 |
| 5,340,144 | 8/1994 | Eleneke | 280/609 |
| 5,462,304 | 10/1995 | Nyman . | |
| 5,580,778 | 12/1996 | Vance | 280/608 |

*Primary Examiner*—Richard M. Camby
*Attorney, Agent, or Firm*—Christensen O'Connor Johnson & Kindness PLLC

[57] ABSTRACT

A double-edged snowboard (10) is disclosed. The snowboard includes a middle portion with a core, a tail (14) at the rear end of the middle portion, a shovel (12) at the front end of the middle portion, and a base (18) along the bottom of the middle, tail, and shovel portions of the snowboard. The base includes a central running surface (24), two outer running surfaces (26 and 28), first and second outer edges (34 and 36), and first and second inner edges (30 and 32). The central running surface is lower than the outer running surfaces. The first and second outer edges surround a portion of the perimeter of the first and second outer running surfaces, respectively. The first and second inner edges are disposed between the central running surface and the first and second outer running surfaces, respectively. The outer edges are generally symmetric about the longitudinal axis of the snowboard, whereas the inner edges may be positioned in a number of ways, depending on the desired performance characteristics of the snowboard. Asymmetric arrangements of the inner edges are disclosed that help accommodate for a skewed foot position on the snowboard. The disclosure also includes a method for manufacturing a dual-edged snowboard consistent with the above description.

28 Claims, 6 Drawing Sheets

DOUBLE-EDGED SNOWBOARD

This application is a continuation application of application Ser. No. 08/758,969, filed on Dec. 2, 1996, abandoned which is a continuation of U.S. application Ser. No. 08/151,344, filed Nov. 12, 1993, now U.S. Pat. No. 5,580,078.

FIELD OF THE INVENTION

This invention relates generally to boards for carrying people over snow and, more particularly, to skis and snowboards.

BACKGROUND OF THE INVENTION

Snowboards are somewhat similar to surfboards in appearance and riding style. They are used to ride on snow rather than surf. A snowboard has a tip or "shovel", a central contact zone, and a tail. The outer sides of boards capable of easily carving turns through the snow have sidecuts, giving the boards a slight hourglass configuration. The base of the snowboard is typically similar to that of snow skis, with steel edges circumscribing the outer shape of the base. A rider stands substantially sideways on the board with his feet skewed toward the shovel of the board. The rider applies pressure to the side of the board corresponding to the desired direction of turn. This causes the board to tilt into the snow on edge and the shovel and tail of the board to flex upwardly relative to the midrunning surface. The radius of curvature of the tilted edge (the "turning edge") causes the board to carve a turn.

Because of the wide running surface of snowboards riders may have difficulty properly tilting a board on edge to carve a turn. To avoid toe or heel drag when turning on edge, the midsection width of the board is approximately equal to the length of the boots of a rider. The shovel and tail are somewhat wider. One approach to overcoming the difficulty in tilting the board to edge is using a narrower board and skewing the feet further to avoid toe or heel drag. However, this approach is limited by the rider's desire to have a substantially sideways stance. The average preferred foot angle from directly sideways is about 27 degrees.

One attempt to provide a narrower base to help a rider to more easily edge, while still avoiding toe or heel drag, is disclosed in U.S. Pat. No. 5,018,760 to Remondet. The Remondet snowboard has an upper portion substantially as wide as the rider's boots are long and a significantly narrower (110 mm narrower) lower portion projecting well below (7 to 8 mm below) the bottom surface of the upper portion. With this narrower running surface the rider can tilt the board to initiate a turn on the narrower base with less force. If the rider continues to tilt the board he can ride on both the inner and outer edges or on the outer edge only. The Remondet board, while being easier to tilt, suffers from snow accumulation between the upper and lower portions. This tends to make the board skid as edge control is lost, especially when tilting the board from an inner to an outer edge. The Remondet configuration also increases friction between the board and the snow surface due to height of the sidewalls of the narrower base. Constructing a board in the configuration taught by Remondet results in a thick board that is too rigid to properly flex for carving. Also, the narrowness of the lower portion of the board and the resulting high angle between the upper and lower portions results in overtracking and makes the board unstable when landing after a jump.

Remondet also teaches that the outer configuration of the board is to be asymmetric for proper force application to the sidecuts, due to a skewed foot stance. However, the skewed upward curvature of the shovel creates a problem. When varying snow conditions, bumps, or depths are encountered, the skewed shovel tends to kick the front of the board in a toe-side direction, which is disconcerting to the rider because it upsets the rider's balance.

As another approach to help overcome edging difficulty, some boards have a slightly convex base (i.e., the base along the longitudinal centerline of the running surface is slightly lower than the edges). This allows the rider to slightly "rocker" the board for smoother edge-to-edge transitions.

While convex bases may be one solution to the difficulty of edging, they create other problems. Convex-based snowboards tend to skid or slide sideways before the edge is fully set, cutting rider speed and control. The board is sloppier since the edges don't bite as readily into the snow. Also, straight-line stability is greatly sacrificed.

An ideal snowboard should maximize the desired advantageous characteristics of the convex base for edge-to-edge board tilting to the outer edges to carve turns, while eliminating the skidding that takes place before a convex base board is tilted enough to firmly set the outside edges. Additionally, poor straight-line stability, inherent in the convex-based boards, should be improved. This invention is directed to providing such a board.

SUMMARY OF THE INVENTION

In accordance with this invention, a new and improved base for snowboards that overcomes the disadvantages outlined above is provided. While primarily intended for use with snowboards having symmetrically shaped sides, the invention can be used with other boards that include runners for carrying people over the snow, such as monoskis and regular downhill skis.

A base formed in accordance with this invention includes a central portion and a first outer portion. The central portion includes a central running surface and a first inner edge. The first inner edge is located along at least a portion of the perimeter of the central running surface. The first outer portion is disposed adjacent the central portion and includes a first outer running surface and a first outer edge. The first outer edge is located along at least portion of the perimeter of the first outer running surface. The first inner edge of the central portion is lower than the first outer edge. The slope of a line running between the first outer edge and the first inner edge lies in the range between 0.5 degrees and 3.0 degrees.

In accordance with other aspects of this invention, the base further includes a second inner edge and a second outer portion. The second inner edge is located along at least a portion of the perimeter of the central running surface on the opposite side of the central running surface from the first inner edge. The second outer portion is disposed adjacent the second inner edge and includes a second outer running surface and a second outer edge. The second outer edge is located along at least a portion of the perimeter of the second outer running surface. The second inner edge of the central portion is lower than the second outer edge. The slope of a line running between the second inner edge and the second outer edge lies in the range between 0.5 degrees and 3.0 degrees. The first and second inner and outer edges are curved inwardly toward the midline of the board from one end of the base to the other end to form an hourglass shape. Further, the central running surface is curved longitudinally and is substantially straight across in a lateral direction along substantially the entire length of the central running surface.

In accordance with further aspects of this invention the outer running surfaces abut the first and second inner edges. The first and second inner edges are thereby located between the central running surface and the outer running surfaces.

In accordance with still other aspects of this invention the first and second inner edges lie generally parallel to the first and second outer edges, respectively, along at least a portion of the length of the base.

In accordance with yet other aspects of this invention, the base further comprises a snow contact zone, a shovel portion in front of the contact zone and a tail portion behind the contact zone. Each of the running surfaces extends along the snow contact zone, the shovel portion, and the tail portion. The first and second inner edges lie parallel to the first and second outer edges, respectively, along the contact zone. The inner edges continue at least partially into said shovel portion and have an outward curvature toward the ends of the base. The outer edges are disposed along at least a portion of the outer perimeter of the shovel portion of the base.

Because the first and second inner and outer edges curve inwardly from one end of the base to the other, each of the edges has a tangent point at which a line tangent to the curvature of the edge at that point lies parallel to the longitudinal axis of the base. In one embodiment of the invention, the running surfaces and the edges are symmetric about the longitudinal axis of the base. The first inner edge and first outer edge are the mirror image of the second inner edge and second outer edge. Thus, the tangent points lie along the same line, which lies orthogonal to the longitudinal axis of the base.

In one alternate embodiment of the invention, the tangent points for the inner edges are shifted nearer the shovel portion of the base than the tangent points for the outer edges. In another alternate embodiment the tangent points for the inner edges are shifted farther from the shovel portion of the base than the tangent points for the outer edges. In still another alternate embodiment the outer edges are symmetric about the longitudinal axis of the base and the inner edges are asymmetric. At least one of the inner edges has its tangent point shifted longitudinally from the tangent points of the outer edges. In one such embodiment, the tangent point of the first inner edge is shifted toward one end of the base and the tangent point of the second inner edge is shifted toward the opposite end of the base. Preferably, in this embodiment, a rider's feet are secured in a skewed position, the toes of the feet being closer to the front of the runner than the heels of the feet. The first inner edge is disposed beneath the toes of the rider and the tangent point of the first inner edge is shifted toward the front of the runner. The second inner edge is disposed beneath the heels of the rider and the tangent point of the second inner edge is shifted toward the rear of the runner.

The foregoing aspects of the invention also can be defined in other ways. If the base is defined as having a front and a rear in some embodiments of the invention, the first inner edge is closer to the first outer edge toward the front of the base than toward the rear of the base. Further, in some embodiments the second inner edge is closer to the second outer edge toward the front of the base than toward the rear of the base. In other embodiments, the second inner edge is closer to the second outer edge toward the rear of the base than toward the front of the base. In still other embodiments the first and second inner edges are closer to the first and second outer edges, respectively, toward the rear of the base.

Alternatively, the embodiments of the invention can be defined in terms of the slope of a line running between the inner and outer edges, with respect to the plane of the central running surface. If the base of the invention is defined as having a front end and a rear end in some embodiments of the invention, the slope of a line between the first inner edge and the first outer edge and the central running surface is greater at the front end of the base than at the rear end. In some embodiments, the slope of a line between the second inner edge and the second outer edge and the central running surface is greater at the rear end of the base than at the front end. Alternatively, in other embodiments, the slope of a line between the second inner edge and the second outer edge and the central running surface is greater at the front end of the base than at the rear end.

As noted above, a base formed in accordance with the invention is preferably embodied in a snowboard. The snowboard comprises a middle portion including a core, a tail at the rear end of the middle portion, a shovel at the front end of the middle portion, and a base along the bottom of the middle, tail, and shovel of the snowboard. The base includes a central running surface, two outer running surfaces, first and second outer edges, and first and second inner edges. The central running surface is lower than the outer running surfaces. The first and second outer edges surround a portion of the perimeter of the first and second outer running surfaces, respectively. The first and second inner edges are disposed between the central running surface and the first and second outer running surfaces, respectively. The slope of a line between the first inner edge and the first outer edge is less than about three degrees and the slope of a line between the second inner edge and the second outer edge is also less than about three degrees.

In one preferred embodiment of a snowboard formed in accordance with the invention the first inner edge is progressively closer to the first outer edge toward the shovel of the snowboard. The second inner edge is progressively closer to the second outer edge as it nears the shovel of the snowboard. In an alternate preferred embodiment of a snowboard formed in accordance with this invention, the second inner edge is progressively closer to the second outer edge as it nears the tail of the snowboard. In another alternate embodiment, the first and second inner edges are progressively closer to the first and second outer edges, respectively, toward the tail of the snowboard. In still another embodiment the outer edges are symmetric about the longitudinal axis of the snowboard and the inner edges are asymmetric. The first inner edge is closer to the first outer edge near the shovel of the snowboard than it is near the tail. The second inner edge is closer to the second outer edge near the tail of the snowboard than it is near the shovel.

The present invention also encompasses a method of constructing a double-edged snowboard. The steps of construction include providing a flat layer of material to be used as a running surface, cutting the flat layer into a generally rectangular shape with inwardly curved sidecuts, cutting two grooves in the flat layer adjacent the sidecuts, positioning outer edges along at least a portion of the perimeter of the flat layer, positioning inner edges within the grooves adjacent the sidecuts, placing the flat layer and edges within a mold, joining a core, and a structural component above the flat layer and edges, and molding the flat layer, edges, core, and structural component into a desired snowboard curvature. The mold has shoulders that elevate the outer edges and the portions of the running surface between the grooves and the perimeter above the level of the portion of the running surface between the grooves. Preferably, the core is stepped such that the portion of the core positioned above the edges is elevated to correspond to the elevation of the outer edges and the portions of the running surface between the grooves and the perimeter. The steps of cutting the flat layer and cutting two grooves are performed by stamping the flat layer with a rule die. The outer edges and running surfaces that are elevated by the shoulders are elevated less than the height of the inner edges. The inner edges are thus locked into position by the flat layer on both sides of the grooves.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
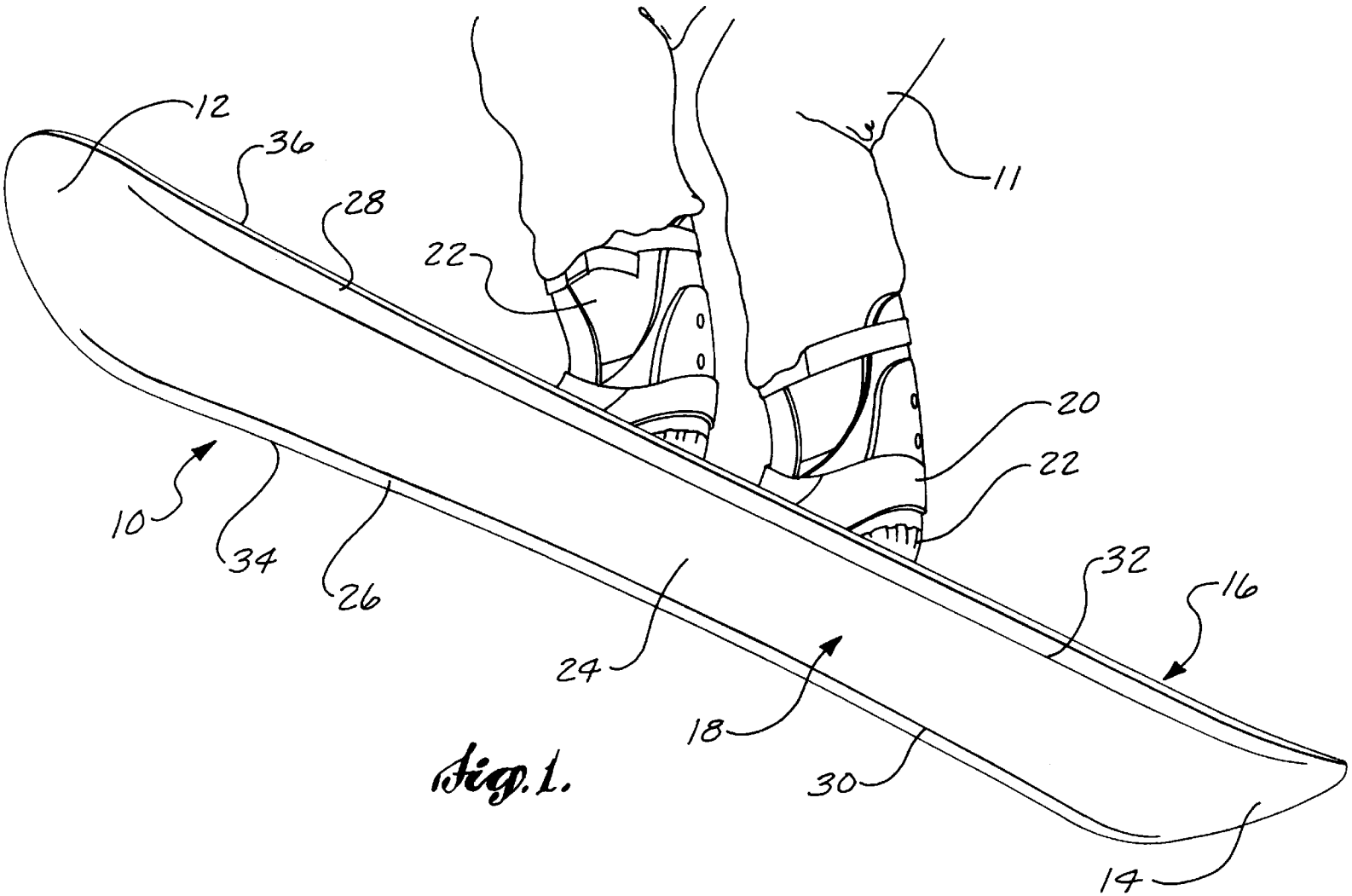
FIG. 1 is a perspective view of a snowboard formed in accordance with the present invention showing a rider secured to the top of the board.

FIG. 1 illustrates a preferred embodiment of a snowboard 10 formed in accordance with the present invention supporting a rider 11. The snowboard 10 includes a shovel 12 that curves upwardly at the front of the snowboard 10 and a tail 14 that curves upwardly at the rear of the snowboard 10. The rider 11 is secured to the top 16 of the snowboard 10 by bindings 20 that hold the rider's boots 22. This is a typical rider position on a snowboard.

A base 18, disposed along the bottom of snowboard 10, includes a central running surface 24, a right running surface 26, and a left running surface 28. Used herein, the directions of left, right, front, and rear are in the context of the position of the rider 11, the part of the board to the rider's right being the "right side" and so forth. The rider 11 is shown and described as having a position generally facing the front and right side of the snowboard 10. However, a "goofy" foot arrangement wherein the rider faces the left side of the snowboard 10 is also contemplated by the invention.

The central running surface 24 is generally rectangular in shape and runs the length and most of the width of the snowboard 10. The central running surface 24 has slight sidecuts on both sides. The central running surface 24 is preferably straight across laterally while being curved vertically along the longitudinal extent of the board to provide camber to the board between the upwardly turned shovel 12 and tail 14.

The right and left running surfaces 26 and 28 are disposed adjacent the sides of the central running surface 24. The base 18 is stepped by forming the central running surface 24 slightly lower than the right and left running surfaces 26 and 28. Preferably, the step between the central running surface 24 and the right and left running surfaces 26 and 28 is 0.72 mm. Alternatively, the step may be between 0.5 mm to 1.3 mm. The right and left running surfaces 26 and 28 also are preferably flat or straight across laterally, while being vertically curved along the longitudinal extent of the board to provide camber to the board in a manner generally corresponding to the curvature of central running surface 24.

A right inner edge 30 is located between the central running surface 24 and the right running surface 26. The right inner edge 30 thus forms the edge of the step between the central running surface 24 and the right running surface 26. Likewise, a left inner edge 32 is positioned between the central running surface 24 and the left running surface 28, and forms the step between those two surfaces. A right outer edge 34 is disposed along the right side of the base 18 and a left outer edge 36 is disposed along the left side of the base 18. Because the base 18 is slightly stepped, the snowboard 10 behaves like a convex-based snowboard in that it is easier to tilt when initiating or coming out of a turn to set an outside edge or move from one outside edge to the other outside edge.

In use, the right and left outer edges 34 and 36 are the principal carving edges of the snowboard 10. The right and left inner edges 30 and 32 form the steps in base 18 to give the rider the feeling of a convex-bottom board. The right and left inner edges 30 and 32 also perform the function of controlling sloppiness or skidding before and after the right or left outer edges 34 or 36 are set when initiating a turn, or coming out of a turn. This can be contrasted to a typical convex-based snowboard that also has ease of turn initiation, edge release, and edge-to-edge transition, but a running surface that tends to skid sideways due to the convex nature of the base not allowing an edge to set as quickly or grab the snow as readily. Like a convex-based snowboard, a snowboard formed in accordance with this invention can also be rockered slightly for ease of turn initiation, edge release, and edge-to-edge transition. This function is carried out by the right and left inner edges 30 and 32 of the snowboard 10. These inner edges give the rider the feel of a convex-based board without having the side skidding that tends to slow the speed of the board and which diminishes the control of the rider over the board. Skidding is prevented by the right and left inner edges. More specifically, the right and left inner edges, which are preferably duller than right and left outer edges 34 and 36, keep snowboard 10 on track when making a transition to an edge or when coming out of an edge. Also, since the central running surface 24 is substantially straight across in a lateral direction along the length of the board 10, straight-line stability is maximized. Thus, the inner edges 30 and 32 provide the benefits of a convex-based snowboard without the drawbacks.

Figure 2:
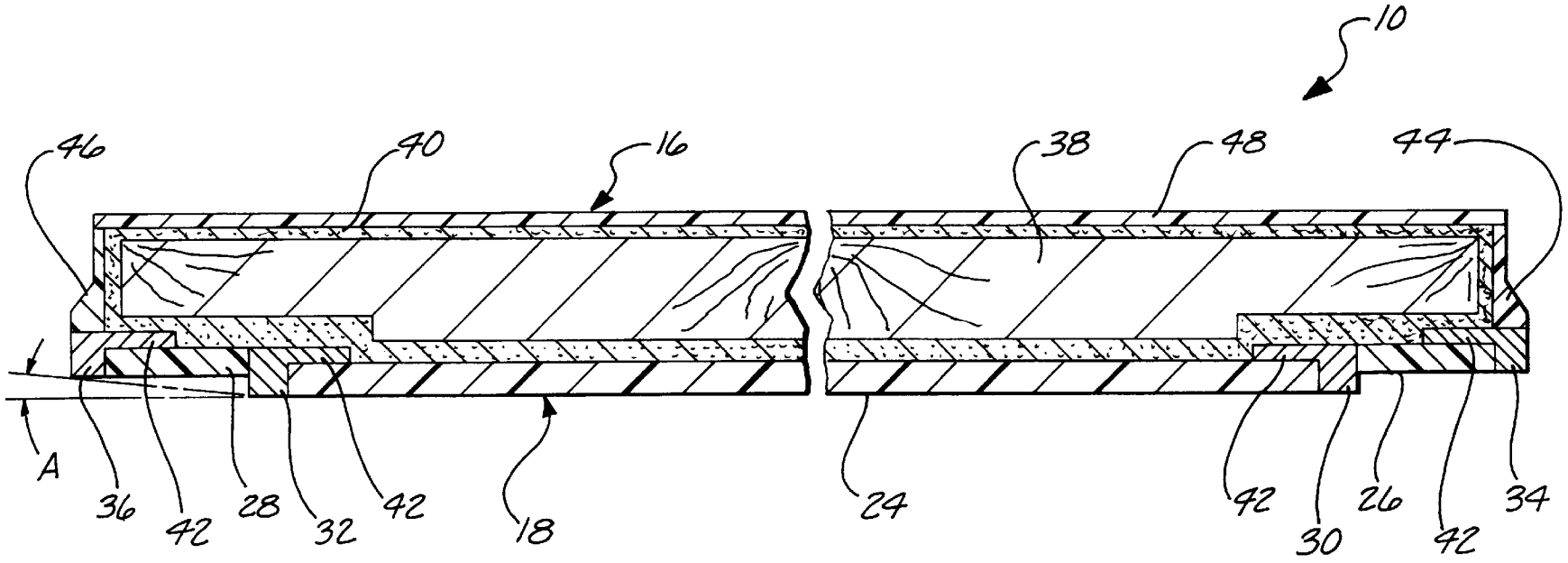
FIG. 2 is an enlarged cross-sectional view of the snowboard illustrated in FIG. 1.

Referring to FIG. 2, the construction of snowboard 10 will now be described in more detail. A core 38 is disposed within snowboard 10 and is generally symmetric about the longitudinal axis of snowboard 10. The core 38 is preferably constructed of wood and has steps on either side corresponding to the stepped base 18. Preferably, the steps of the core 38 are inside of the right and left inner edges 30 and 32. The core 38 is surrounded by a torsion box 40 preferably constructed of a composite thermoset material such as fiberglass. Other structural configurations or components may alternatively be used.

The running surfaces 24, 26, and 28 are located below the torsion box 40. The running surfaces 24, 26, and 28 are preferably made of P-tex plastic. P-tex is the standard material used on bases on standard downhill skis or snowboards. The central running surface 24 is bound on its right and left sides by the right and left inner edges 30 and 32, respectively. All of the edges 30, 32, 34, and 36 are preferably standard metal edges typically used in skis or snowboards. They include edge ears 42 that project inwardly and are held in place between the P-tex and fiberglass layers of the running surfaces 24, 26, and 28, and torsion box 40, respectively. The right and left inner edges 30 and 32 are also locked in place by the right and left running surfaces 26 and 28 abutting against the right and left inner edges 30 and 32. The running surfaces 24, 26, and 28 are preferably approximately 1.2 mm thick. As a result, a preferred edge thickness of 1.92 mm results in steps of 0.72 mm being formed between the central running surface 24 and the right and left running surfaces 26 and 28. The right and left running surfaces 26 and 28 are bounded on their outer sides by the right and left outer edges 34 and 36, respectively.

To protect the sides of the torsion box 40, right and left sidewalls 44 and 46, disposed above right and left outer edges 34 and 36, respectively, shield the sides of snowboard 10. A top layer 48 is disposed over the entire top surface of the snowboard 10 to protect the top of torsion box 40, and to support top graphics. The top layer 48 and sidewalls 44 and 46 are preferably constructed of acrylonitrile butadiene-styrene (ABS), but may be constructed of other materials. Alternatively, top layer 48 may be integral with the right and left sidewalls 44 and 46 and extend down the sides of snowboard 10.

Of particular note in FIG. 2 is the angle A that represents the edge slope of snowboard 10. Edge slope angle A is the angle that the slope of a line between corners of right inner edge 30 and the right outer edge 34 or between the left inner edge 32 and left outer edge 36 makes with the central running surface 24. In the preferred embodiments of the invention, edge slope angle A is between 1 degree and 1.6 degrees. However, angles ranging anywhere between 0.5 degree and 3 degrees are contemplated. In the preferred embodiments illustrated and described herein, angle A lies between 1 degree and 1.6 degrees, the optimal range. Within these ranges, the board acts as a convex-based board for ease of turn initiation, edge release, and edge-to-edge transition. The board rides on all the running surfaces 24, 26, and 28, and provides a stable base for landings from jumps. When edge slope angle A lies within this range snow does not accumulate in the area between the inner and outer edges. The preferred way of varying the edge slope angle A along the length of the board is by moving the inner and outer edges closer together or farther apart. However, other methods of changing the angle may be used, such as increasing the height of the step above 0.72 mm or decreasing the height of the step below 0.72 mm. Alternatively, both the height of the step and the lateral distance between the edges may be varied to vary the edge slope angle A.

FIGS. 3 through 6 illustrate the bottom of four different embodiments of snowboards formed in accordance with the invention. The differences between the embodiments illustrated in FIGS. 3–6 and described below lie in the position of the right and left inner edges 30 and 32 on the base 18.

Figure 3:
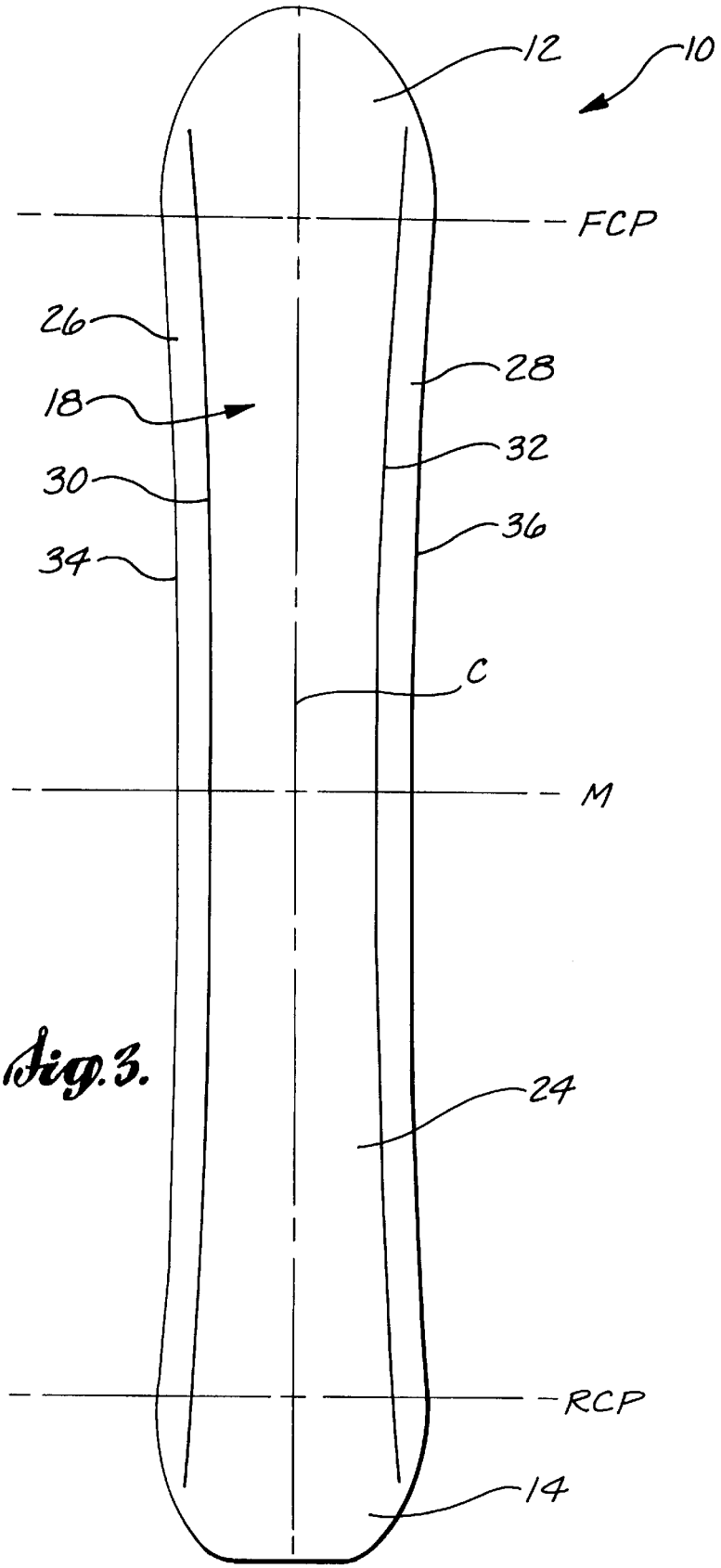
FIG. 3 is a bottom view of a preferred embodiment of a snowboard formed in accordance with the present invention that has symmetric inner edges.

The preferred embodiment of a snowboard 10 formed in accordance with this invention shown in FIG. 3 includes inner edges 30 and 32 running parallel to outer edges 34 and 36 between a front contact point (FCP) located near the wide part of the front of snowboard 10 adjacent shovel 12 and a rear contact point (RCP) located near the wide part of the snowboard 10 near tail 14. In other words, the curvature of the right inner edge 30 is the same as the curvature of the right outer edge 34 between the FCP and the RCP and the curvature of the left inner edge 32 is the same as the left outer edge 36 between the FCP and the RCP. While the right and left inner edges 30 and 32 extend onto the shovel 12 and the tail 14 beyond the FCP and the RCP, respectively, in these regions the inner edges 30 and 32 are no longer parallel to the outer edges 34 and 36. Inner edges 30 and 32 continue along their same paths of curvature onto shovel 12 and tail 14. This arrangement provides the advantage of a more stable board when encountering differing snow conditions, bumps, or depths. As the front or rear of snowboard 10 encounters differing snow depths, for example, snowboard 10 is not as likely to be thrown to the right or the left since the curvature of inner edges 30 and 32 continues onto shovel 12.

Another way of describing the parallel nature of inner and outer edges 30, 32, 34, and 36, in the preferred embodiments of the invention, is to focus on the points where lines that are tangent to the curvature of the edges lie parallel to the longitudinal axis C of the snowboard 10. In the preferred embodiment illustrated in FIG. 3, the points along each edge at which lines that lie tangent to the edge are parallel to the longitudinal axis of snowboard 10 are all disposed along the midline, M, of the snowboard 10.

Figure 4:
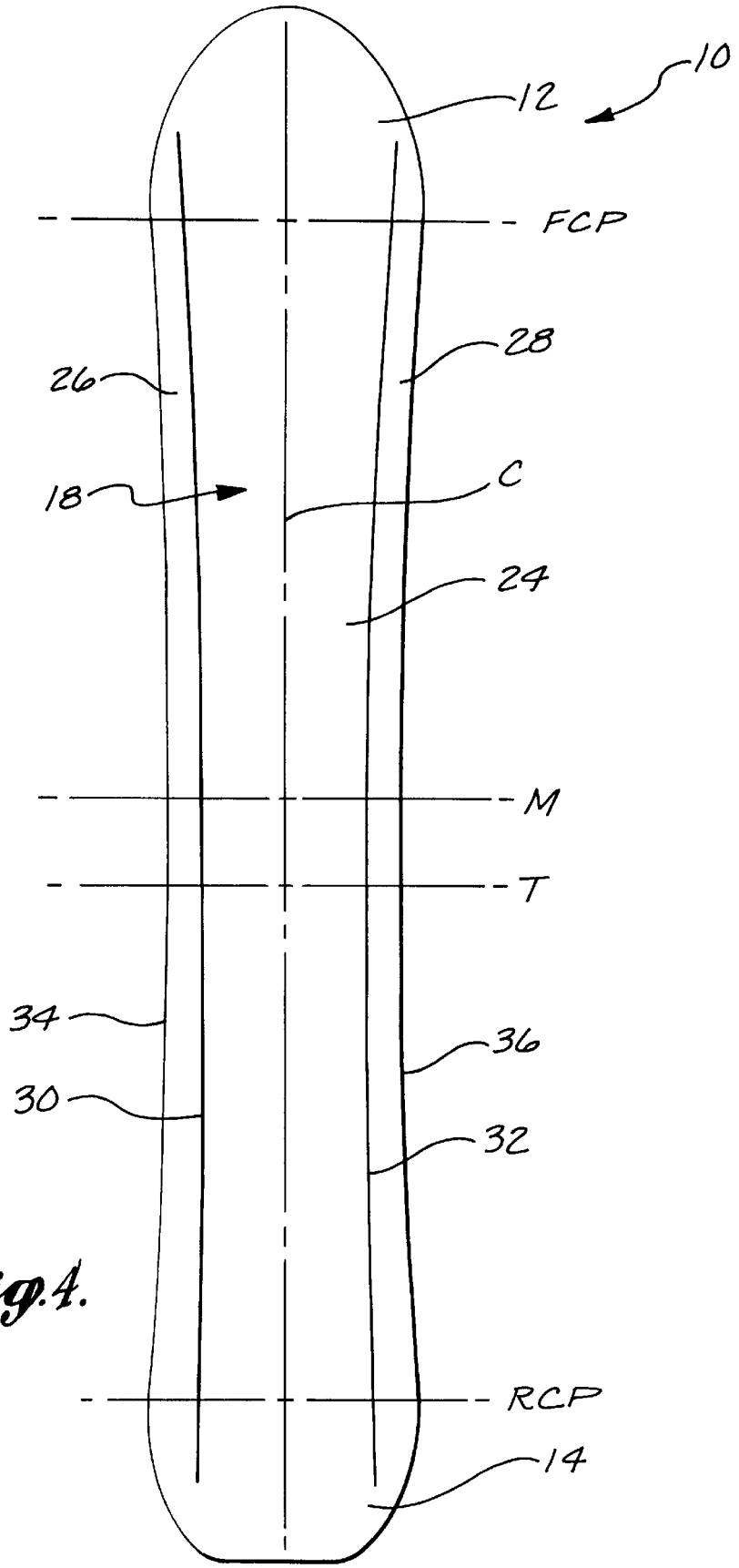
FIG. 4 is a bottom view of another preferred embodiment of a snowboard formed in accordance with the present invention that has inner edges with rearwardly shifted curvatures.

Referring now to FIG. 4, another preferred embodiment of the invention is illustrated in which inner edges 30 and 32 are closer to outer edges 34 and 36 at the front of snowboard 10 and are farther from outer edges 34 and 36 at the rear of snowboard 10. This configuration results in the tangent points of the inner edges 30 and 32 (as defined above), which are disposed along line T, being positioned rearward of the tangent points of the outer edges 34 and 36, which are disposed along line M.

The embodiment illustrated in FIG. 4, with inner edges 30 and 32 being wider apart at the front of snowboard 10, has the advantages of better tracking and high-speed stability. Better tracking results because a wide inner track is created in the snow as the front of snowboard 10 passes over the snow. The rear portion of central running surface 24 is narrower and, thus, readily follows the trail made by the forward end of central running surface 24.

Figure 5:
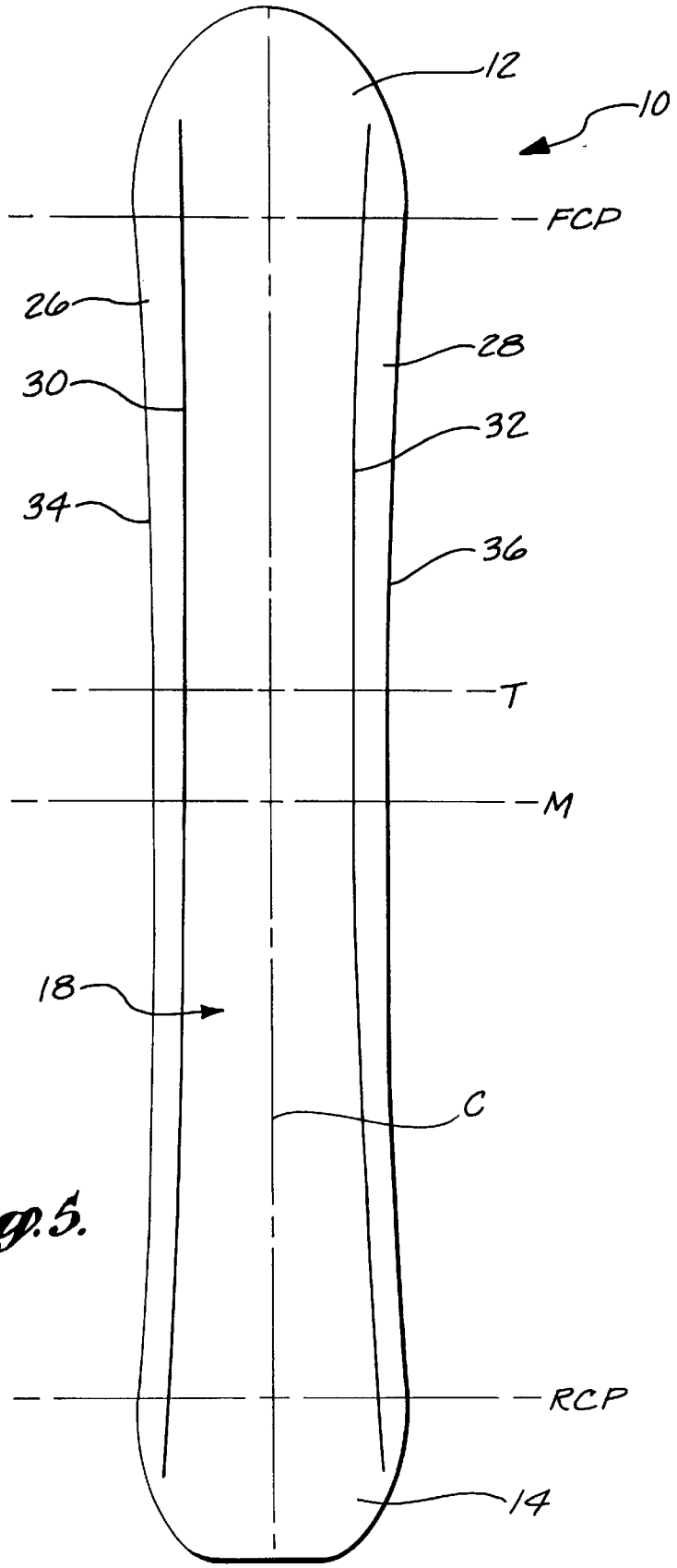
FIG. 5 is a bottom view of another embodiment of a snowboard formed in accordance with the present invention that has inner edges with forwardly shifted curvatures.

FIG. 5 illustrates an embodiment of a snowboard formed in accordance with the invention that is opposite the arrangement of the embodiment illustrated in FIG. 4. Specifically, the inner edges 30 and 32 of the embodiment shown in FIG. 5 are closer to the outer edges 34 and 36 at the rear of the snowboard and farther from the outer edges 34 and 36 at the front of the snowboard. As a result, the tangent points of the inner edges 30 and 32, which lie along line T are positioned forward of the tangent points of the outer edges 34 and 36, which lie along line M.

The construction of base 18 in this embodiment facilitates quicker turning, since edge slope angle A is smaller at the front of snowboard 10 than at the rear of snowboard 10. Because the edge slope angle A is smaller, the outer edges 34 and 36 at the front are quicker to grab into the snow and initiate a turn. Thus, the snowboard is quicker turning. As the snowboard 10 proceeds through a turn and is shifted in the other direction to initiate another turn, the longer edge slope angle A at the rear of the snowboard 10 results in quicker release of the outer edges 34 and 36 at the rear of the snowboard 10. Thus, turn-to-turn transitions of this snowboard are quicker.

Figure 6:
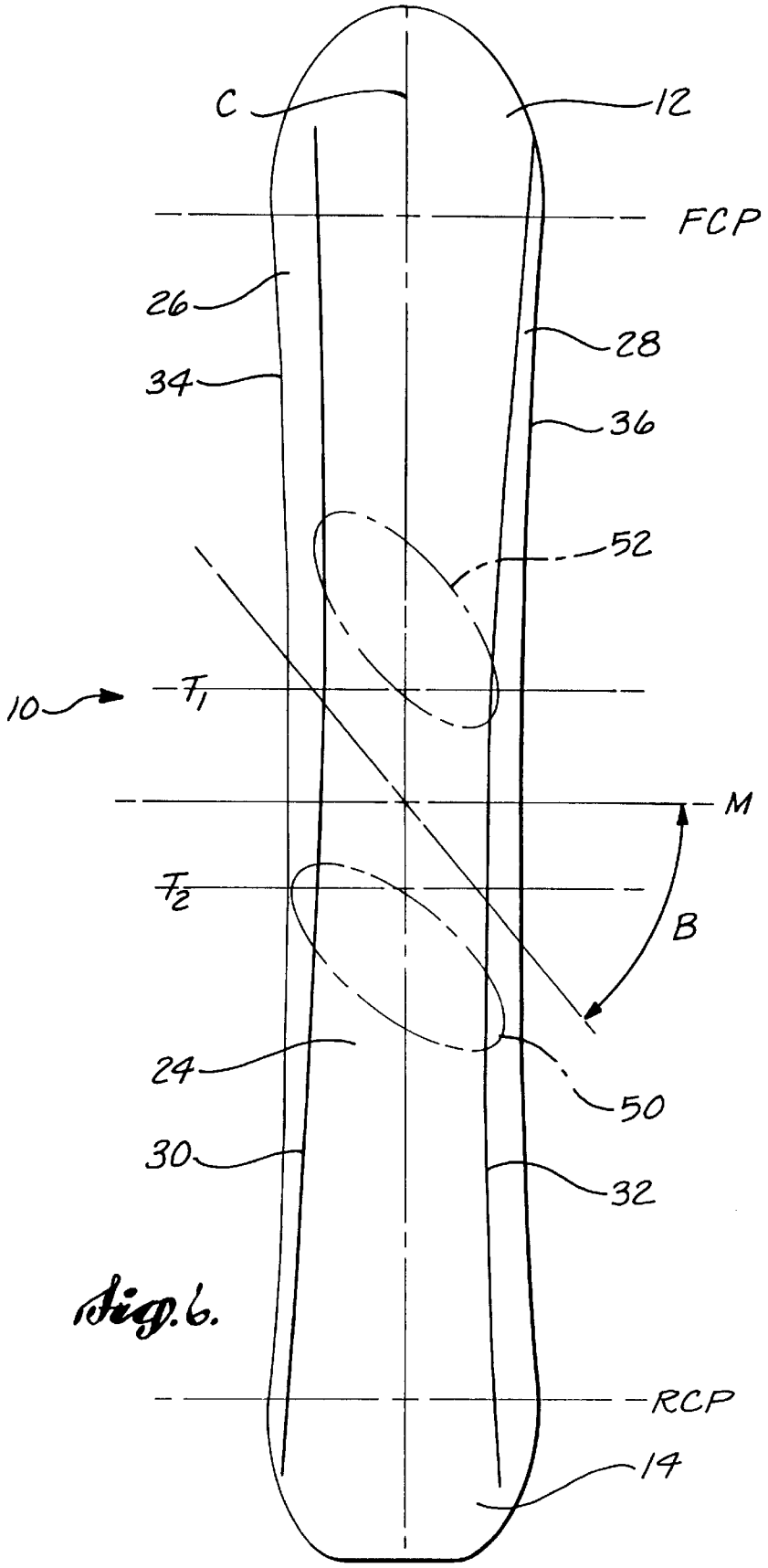
FIG. 6 is a bottom view of another embodiment of a snowboard formed in accordance with the present invention that has asymmetric inner edges.

Referring now to FIG. 6, a preferred embodiment of an asymmetric-based snowboard formed in accordance with this invention will now be described. The preferred stance when using a snowboard is to have the toes of the foot shifted slightly toward the front of a snowboard and the heels shifted slightly toward the rear such that a skewed position results. The rear foot 50 is typically not pointed forward as much as the front foot 52. Different riders have different preferences as to the exact angle of each foot. On average, an angle of approximately 27 degrees from midline M is preferred. This foot position, while being most comfortable to the rider, places forces on the right side of snowboard 10 in different locations longitudinally from the forces on the left side of snowboard 10. Placement of the forces depends upon whether the rider is facing the right side of the board or the left side of the board ("goofy" foot position), and upon the amount of skew in each individual foot. Regardless of rider orientation, the length of the board in front of the heel of the front foot 52 is longer than the length of the board in front of the toes of front foot 52. Further, the length of the board behind the heel of the rear foot is shorter than the length of the board behind the toes of rear foot 50. Because of this difference in longitudinal location, the force applied by a snowboard rider of his heels or toes causes the front of the board to flex more on a heel-side turn than on a toe-side turn. This flex causes the outer edges 34 and 36 to grab the snow quicker and initiate the turn sooner on a heel-side turn than on a toe-side turn. Likewise, the toe-side edge does not release as quickly from the snow when coming out of a turn as does the heel-side edge, since the toes of rear foot 50 are farther from tail 14 than are the heels of the rear foot 50.

The snowboard 10 illustrated in FIG. 6 evens out the turn initiation and edge release characteristics by shifting the inner edges 30 and 32 by an amount corresponding to the approximate angle of foot skew. Thus, the tangent point of the left inner edge 32 represented by line $T_2$ is shifted rearwardly of midline M. This makes the front of the left inner edge 32 closer to the left outer edge 36, thus increasing the edge slope angle A near the front of the snowboard 10 and decreasing the edge slope angle A near the rear of the snowboard 10. As explained above, a greater edge slope angle A slightly delays the set or grab of an outer edge, while a lesser edge slope angle A slightly speeds up the set or grab of the outer edge. The left inner edge 32 in front of the heel of the front foot progressively gets closer to the left outer edge 36 to retard the edge grip, since the force applied to the heel is farther back from the force applied to the toe. Conversely, the tangent point of the right inner edge 30, represented by line $T_1$ is shifted forwardly of midline M. As a result, the edge slope angle A is smaller near the front of the board and larger near the rear. This allows the right outer edge 34 to set more easily. While the toes of the forward foot are nearer shovel 12, the angle is smaller.

The shift of inner edges 30 and 32 is opposite at the rear of snowboard 10 to allow the heel side of the board to edge more easily and the toe side of the board to come off of an edge more quickly due to the skewed nature of rear foot 50. A shift angle B represents the amount of shift of inner edges 30 and 32 from midline M. Optimally, shift angle B is between zero and 50 degrees. A preferred shift angle of 27 degrees corresponds to the standard foot angle of 27 degrees.

The method of construction of snowboard 10 will now be discussed. First, a layer of P-tex for running surfaces 24, 26, and 28 is created. A sheet of P-tex is stamped with a rule die to form the desired exterior shape and, at the same time, to cut grooves to receive the steel edges that protrude through the P-tex to form inner edges 30 and 32. See FIG. 2.

Outer edges 34 and 36 are then glued onto portions of the perimeter of the P-tex. The inner edges 30 and 32 are placed in the grooves cut in the P-tex and are glued into place. At this point, the P-tex and the edges are still flat.

The P-tex and the edges 30, 32, 34, and 36 are next placed in a mold. The mold includes shoulders along the sides that lift the right and left running surfaces 26 and 28, and the outer edges 34 and 36 relative to the central running surface 24. The shoulders elevate the right and left running surfaces 26 and 28 and the outer edges 34 and 36 a predetermined amount, preferably 0.72 mm, above the central running surface 24 and the inner edges 30 and 32.

Longitudinally oriented fiberglass is then placed on top of the P-text and is wetted with a thermoset resin.

The stepped wood core 38 is wrapped in bidirectional fiberglass to construct torsion box 40 around core 38. While still wet, wrapped core 38 is placed into the mold on top of the P-tex of running surfaces 24, 26, and 28, edges 30, 32, 34, and 36, and the longitudinal fiberglass. Preferably, a shovel and tail protection device, such as an aluminum plate or wrapped steel edges and ABS fillers (not shown) are placed in the forward and rearward ends of snowboard 10 in a conventional fashion.

A second layer of longitudinal fiberglass is placed on top of the wrapped core 38 after which the top layer 48 is placed above the second layer of longitudinal fiberglass and sidewalls 44 and 46 are put in place. Top layer 48 and sidewalls 44 and 46 are also preferably constructed of ABS.

The mold with all of the above-described components is then covered with an aluminum sheet and placed in a press that has the desired curvature to form the camber and upwardly turned shovel 12 and tail 14 of snowboard 10. The mold and snowboard 10 are then bent to shape by the press, which uses compression and heat to bend and set snowboard 10 in the desired shape in a conventional manner.

While preferred embodiments of the invention have been illustrated and described, it will be appreciated that various changes can be made therein without departing from the spirit and scope of the invention. For example, the invention is not limited to applications in snowboards, but may also be used on the runners of other products designed to glide over snow or ice, such as skis or monoskis.

The embodiments of the invention in which an exclusive property or privilege is claimed are defined as follows:

1. A base for a runner for gliding over snow, the runner having a core, the base comprising:

(a) a central portion coupled to the core, said central portion including a central running surface, generally defining a central surface plane, and a first inner edge located along at least a portion of the perimeter of said central running surface; and (b) a first outer portion disposed adjacent said central portion, said first outer portion including a first outer running surface and a first outer edge located along at least a portion of the perimeter of said first outer running surface, wherein said first inner edge of said central portion is lower than said first outer edge, the angle generally midway along the length of said central running surface between the central surface plane and a line running between the first outer edge and the first inner edge lying in the range of between 0.5 and 3.0 degrees.

2. The base of claim 1, further comprising a second inner edge and a second outer portion, said second inner edge being located along at least a portion of the perimeter of said central running surface on the opposite side of said central running surface from said first inner edge, said second outer portion being disposed adjacent said second inner edge, said second outer portion including a second outer running surface and a second outer edge located along at least a portion of the perimeter of said second outer running surface, wherein said second inner edge of said central portion is lower than said second outer edge, the angle generally midway along the length of said central running surface between the central surface plane and a line running between said second inner edge and said second outer edge lying in the range of between 0.5 and 3.0 degrees.

3. The base of claim 2, wherein said central running surface is curved longitudinally and substantially straight across in a lateral direction along substantially the entire length of said central running surface.

4. The base of claim 2, wherein said first and second outer running surfaces abut said first and second inner edges, respectively, said first and second inner edges being locked into position between said central running surface and said outer running surfaces.

5. The base of claim 2, wherein said first inner edge lies generally parallel to said first outer edge along at least a portion of the length of the base and said second inner edge lies substantially parallel to said second outer edge along at least a portion of the length of the base.

6. The base of claim 5, further comprising a snow contact zone, a shovel portion in front of said snow contact zone, and a tail portion behind said contact zone, wherein each of said running surfaces extends along said snow contact zone, onto said shovel portion, and onto said tail portion, wherein said first and second inner edges lie parallel to said first and second outer edges, respectively, along said snow contact zone, and wherein said inner edges continue at least partially into said shovel portion, said inner edges having an outward curvature toward the ends of the base, said inner edges continuing in generally the same outward curvature as they extend into said shovel portion of the base, said outer edges being disposed along at least a segment of the outer perimeter of said shovel portion of the base.

7. The base of claim 6, wherein said running surfaces and said edges are symmetric about the longitudinal axis of the base, said first inner edge and said first outer edge being the mirror image of said second inner edge and second outer edge.

8. The base of claim 2, further comprising a shovel portion at one end of said running surfaces and wherein said inner edges continue at least partially into said shovel portion, said inner edges having an outward curvature toward the ends of the base, said inner edges continuing in generally the same outward curvature as they extend into said shovel portion of the base, said outer edges being disposed along at least a portion of the outer perimeter of said shovel portion of the base.

9. The base of claim 8, wherein said running surfaces and said edges are symmetric about the longitudinal axis of the base, the first inner edge and first outer edge being the mirror image of the second inner edge and second outer edge.

10. The base of claim 2, wherein each of said edges has a tangent point at which a line tangent to the curvature of the edge at that point is parallel to the longitudinal axis of the base, and wherein the tangent points for said inner edges are shifted nearer the shovel of the base than are the tangent points for said outer edges.

11. The base of claim 2, wherein the base has a front and a rear, said first inner edge being closer to the first outer edge toward the front of the base than it is toward the rear of the base.

12. The base of claim 11, wherein the second inner edge is closer to the second outer edge toward the front of the base than it is toward the rear of the base.

13. The base of claim 2, wherein the base has front and rear ends, the slope of a line running between said first inner edge and said first outer edge with respect to the plane of said central running surface is greater at the front end of the base than at the rear end.

14. The base of claim 13, wherein the slope of a line between said second inner edge and said second outer edge is greater at the front end of the base than it is at the rear end.

15. A snowboard comprising:

(a) a middle portion including a core;

(b) a tail at the rear of said middle portion;

(c) a shovel at the front end of said middle portion; and (d) a base along the bottom of the middle, tail, and shovel of the snowboard, said base including:

(i) a central running surface generally defining a central surface plane;

(ii) two outer running surfaces, a portion of said central running surface along said middle portion being lower than said outer running surfaces along said middle portion;

(iii) first and second outer edges surrounding a portion of the perimeter of said first and second outer running surfaces, respectively; and (iv) first and second inner edges disposed between said central running surface and said first and second outer running surfaces, respectively; the angle generally midway along the length of said central running surface between the central surface plane and a line between the first inner edge and the first outer edge being less than about 3.0 degrees and the angle generally midway along the length of said central running surface between the central surface plane and a line between the second inner edge and the second outer edge being less than about 3.0 degrees.

16. The snowboard of claim 15, wherein said central running surface is laterally substantially flat and longitudinally curved.

17. The snowboard of claim 15, wherein said outer running surfaces abut said first and second inner edges, respectively, said first and second-inner edges being locked into position between said central running surface and said outer running surfaces.

18. The snowboard of claim 15, wherein said first inner edge is progressively closer to the first outer edge toward the shovel of the snowboard.

19. The snowboard of claim 18, wherein the second inner edge is progressively closer to the second outer edge toward the shovel of the snowboard.

20. The snowboard of claim 18, wherein the second inner edge is progressively closer to the second outer edge toward the tail of the snowboard.

21. The snowboard of claim 22, wherein said first and second inner edges are progressively closer to said first and second outer edges, respectively, toward the tail of the snowboard.

22. The snowboard of claim 15, wherein the slope of a line between said first inner edge and said first outer edge is greater near the shovel of said snowboard than it is near said tail.

23. The base of claim 22, wherein the slope of a line between said second inner edge and said second outer edge is greater near the shovel of the snowboard than it is near the tail.

24. A base for a runner for gliding over snow, the runner having a core, the base comprising:

(a) a central portion coupled to the core, said central portion including a central running surface and first and second inner edges located along at least a portion of the perimeter of said central running surface, said second inner edge being located along at least a portion of the perimeter of said central running surface on the opposite side of said central running surface from said first inner edge;

(b) a first outer portion disposed adjacent said first inner edge, said first outer portion including a first outer running surface and a first outer edge located along at least a portion of the perimeter of said first outer running surface, wherein said first inner edge of said central portion is lower than said first outer edge; and (c) a second outer portion disposed adjacent said second inner edge, said second outer portion including a second outer running surface and a second outer edge located along at least a portion of the perimeter of said second outer running surface, wherein said second inner edge of said central portion is lower than said second outer edge;

wherein each of said edges have a tangent point at which a line tangent to the curvature of the edge at that point is parallel to the longitudinal axis of the base, said outer edges are symmetric about the longitudinal axis of the base, said inner edges are parallel with respect to said outer edges, and the tangent points of said inner edges and the tangent points of said outer edges lie along a common lateral line that lies orthogonal to the longitudinal axis of the base.

25. A base for a runner for gliding over snow, the base having a front, the base comprising:

(a) a central portion including a central running surface, generally defining a central surface plane;

(b) a first inner edge located along at least a portion of the perimeter of said central running surface;

(c) a first outer portion disposed adjacent said first inner edge, said first outer portion including a first outer running surface;

(d) a first outer edge located along at least a portion of the perimeter of said first outer running surface;

(e) a second inner edge located along at least a portion of the perimeter of said central running surface on the opposite side of said central running surface from said first inner edge;

(f) a second outer portion disposed adjacent said second inner edge, said second outer portion including a second outer running surface; and (g) a second outer edge located along at least a portion of the perimeter of said second outer running surface, wherein (i) said first and second inner edges of said central portion are lower than said first and second outer edges, respectively; (ii) said inner edges are aparallel with respect to said outer edges; (iii) said inner and outer edges are longitudinally symmetric; and (iv) each of said edges has a tangent point at which a line tangent to the curvature of the edge at that point lies parallel to the longitudinal axis of the base, the tangent points of said inner edges being shifted farther from the front of the base than are the tangent points of said outer edges.

26. A base for a runner for gliding over snow, the base having a front, the base comprising:

(a) a central portion including a central running surface, generally defining a central surface plane;

(b) a first inner edge located along at least a portion of the perimeter of said central running surface;

(c) a first outer portion disposed adjacent said first inner edge, said first outer portion including a first outer running surface;

(d) a first outer edge located along at least a portion of the perimeter of said first outer running surface;

(e) a second inner edge located along at least a portion of the perimeter of said central running surface on the opposite side of said central running surface from said first inner edge;

(f) a second outer portion disposed adjacent said second inner edge, said second outer portion including a second outer running surface; and (g) a second outer edge located along at least a portion of the perimeter of said second outer running surface, wherein (i) said first and second inner edges of said central portion are lower than said first and second outer edges, respectively; (ii) said inner edges are parallel with respect to said outer edges; (iii) said inner and outer edges are longitudinally symmetric; and (iv) each of said edges has a tangent point at which a line tangent to the curvature of the edge at that point lies parallel to the longitudinal axis of the base, the tangent points of said inner edges being shifted closer to the front of the base than are the tangent points of said outer edges.

27. A base for a runner for gliding over snow, the base having a front and a rear, the base comprising:

(a) a central portion including a central running surface, generally defining a central surface plane;

(b) a first inner edge located along at least a portion of the perimeter of said central running surface;

(c) a first outer portion disposed adjacent said first inner edge, said first outer portion including a first outer running surface;

(d) a first outer edge located along at least a portion of the perimeter of said first outer running surface;

(e) a second inner edge located along at least a portion of the perimeter of said central running surface on the opposite side of said central running surface from said first inner edge;

(f) a second outer portion disposed adjacent said second inner edge, said second outer portion including a second outer running surface; and (g) a second outer edge located along at least a portion of the perimeter of said second outer running surface, wherein (i) said first and second inner edges of said central portion are lower than said first and second outer edges, respectively; (ii) said first inner edge is closer to said first outer edge toward the rear of the base then it is toward the front of the base; and (iii) said second inner edge is closer to said second outer edge toward the rear of the base then it is toward the front of the base.

28. A base for a runner for gliding over snow, the runner having a core, the base comprising:

(a) a central portion including a central running surface, generally defining a central surface plane;

(b) first and second inner edges located along at least a portion of the perimeter of said central running surface, said second inner edge located along at least a portion of the perimeter of said central running surface on the opposite side of said central running surface from said first inner edge;

(c) a first outer portion disposed adjacent said central portion, said first outer portion including a first outer running surface and a first outer edge located along at least a portion of the perimeter of said first outer running surface;

(d) a second outer portion disposed adjacent said second inner edge, said second outer portion including a second outer running surface and a second outer edge located along at least a portion of the perimeter of said second outer running surface, wherein (i) said first and second inner edges of said central portion are lower than said first and second outer edges, respectively; (ii) each of said edges has a tangent point at which a line tangent to the curvature of the edge at that point lies parallel to the longitudinal axis of the base; (iii) said outer edges are symmetric about the longitudinal axis of the base; (iv) said inner edges are asymmetric; and (v) at least one of said inner edges has its tangent point shifted longitudinally from the tangent points of said outer edges, the tangent point of said first inner edge being shifted toward one end of the base and the tangent point of said second inner edge being shifted toward the opposite end of the base.

* * * * *

UNITED STATES PATENT AND TRADEMARK OFFICE

CERTIFICATE OF CORRECTION

PATENT NO. : 5,871,224
DATED : February 16, 1999
INVENTOR(S) : M.D. Vance

It is certified that error appears in the above-identified patent and that said Letters Patent is hereby corrected as shown below:

On the title page, item:

| | | |
|---|---|---|
| [56] Pg. 1, col. 2 | Refs. Cited (U.S. Pats., item 10) | "5,580,778" should read --5,580,078-- |

| COLUMN | LINE | |
|---|---|---|
| 12 (Claim 17, | 39 line 3) | "second-inner" should read --second inner-- |
| 12 (Claim 21, | 51 line 1) | "of claim 22," should read --of claim 15,-- |
| 13 (Claim 25, | 51 line 24) | "aparallel" should read --parallel-- |
| 14 (Claim 27, | 49 line 25) | "then" should read --than-- |

UNITED STATES PATENT AND TRADEMARK OFFICE

CERTIFICATE OF CORRECTION

PATENT NO. : 5,871,224

DATED : February 16, 1999

INVENTOR(S) : M.D. Vance

It is certified that error appears in the above-identified patent and that said Letters Patent is hereby corrected as shown below:

| COLUMN | LINE | ERROR |
|---|---|---|
| 14 (Claim 27, | 51 line 27) | "then" should read --than-- |

Signed and Sealed this

Seventh Day of September, 1999

*Attest:*

Q. TODD DICKINSON

*Attesting Officer*

*Acting Commissioner of Patents and Trademarks*